US005224401A

United States Patent [19]

Cesari et al.

[11] Patent Number: 5,224,401

[45] Date of Patent: Jul. 6, 1993

[54] VICING TOOL FOR INTERNALLY GRIPPING HOLLOW BODIES, IN PARTICULAR, THOSE OF TUBULAR NATURE

[75] Inventors: Antonio Cesari; Gaetano Desantis, both of Florence, Italy

[73] Assignee: Michela Papi, Florence, Italy

[21] Appl. No.: 834,531

[22] PCT Filed: Jun. 10, 1991

[86] PCT No.: PCT/IT91/00047

§ 371 Date: Feb. 11, 1992

§ 102(e) Date: Feb. 11, 1992

[87] PCT Pub. No.: WO91/19594

PCT Pub. Date: Dec. 26, 1991

[30] Foreign Application Priority Data

Jun. 12, 1990 [IT] Italy ..... 9425 A/90

[51] Int. Cl.[5] ..... B25B 23/00

[52] U.S. Cl. ..... 81/442; 81/448; 81/302; 81/485; 81/426.5; 269/48.1; 269/6

[58] Field of Search ..... 81/442, 448, 449, 450, 81/302, 420, 424.5, 426.5, 485; 269/217, 48, 48.1, 48.2, 48.3, 48.4, 6

[56] References Cited

U.S. PATENT DOCUMENTS 1,388,744 8/1921 Morrissey .
1,880,172 9/1932 Bergman et al. .
2,418,626 4/1947 Damrell .

FOREIGN PATENT DOCUMENTS 2326998 5/1977 France .
2406484 5/1979 France .

*Primary Examiner*—D. S. Meislin
*Attorney, Agent, or Firm*—Browdy and Neimark

[57] ABSTRACT

A vicing tool for internally gripping hollow bodies, in particular, those of a tubular nature, which comprises a body (1) created in two halves (1*a*, 1*b*) having two mating faces (2*a*, 2*b*) and angularly displaceable with respect to one another about a rotational axis (X) coincident with a common edge (4) of said faces as well as means (8) for imparting to said two halves of said body said angular displacement. From at least one side of said body a nose (12) extends formed by two elongated members (12*a*, 12*b*) having substantially semicylindrical lateral surfaces, extending from said two halves of said body and connected coplanarly to said faces. The nose (12) is composed of longitudinal concentric portions (13*a*, 13*b*, 13*c* 13*d*), of increasing diameter starting from its free end, and the rotational axis (X) is parallel and eccentric with respect to the longitudinal axis of said nose.

11 Claims, 1 Drawing Sheet

VICING TOOL FOR INTERNALLY GRIPPING HOLLOW BODIES, IN PARTICULAR, THOSE OF TUBULAR NATURE

DESCRIPTION

1. Technical Field

The present invention relates to a vicing tool for internally gripping hollow bodies, in particular, those of tubular nature.

2. Background Art

In many cases, in the mechanical and above all plumber fields, blocking, releasing, screwing, unscrewing, inserting and extracting hollow bodies from a support in which they are engaged can be problematic, because they do not offer a sufficient gripping surface for being grasped from the outside with a suitable tool (pliers, wrench and similar). This is the case, for example, of pipe connectors which are immured or built into walls. For instance, in the case of a wall set for a wash basin, an inconvenience which very frequently occurs is that of finding, during its replacement, a loss of water caused by the displacement of the pipe connector between the internally immured tubing and the set itself which resultingly looses its capacity for retention. In circumstances such as this, currently, to render possible the disassembly and reassembly while maintaining the pipe connector's capacity for retention, it is necessary to demolish decorative tiles and masonry surrounding the pipe connector in question for the purpose of making space in which to manoeuvre suitable tools.

It is one object of the present invention to provide a vicing tool capable of internally gripping hollow bodies, in particular those of tubular nature, allowing for their disengagement from respective supports.

Another object of the present invention is to provide a vicing tool of the above mentioned type which can be utilized for a sufficiently ample range of internal diameters.

A particular object of this invention is to provide a vicing tool of the above mentioned type which is easily transportable as well as simple and convenient to use.

DISCLOSURE OF THE INVENTION

The above stated objects are accomplished with a vicing tool for internally gripping hollow bodies, particularly those of tubular nature, which is characterized in that it comprises a body made in two halves having two mating faces and angularly displaceable with respect to one another about a rotational axis coincident with a common edge of said faces, and means for imparting to said two halves of said body said angular displacement, from at least one side of said body extending a nose formed by two elongated members of substantially semicylindrical lateral surfaces, extending from said two halves of said body and connecting in a common plane said faces, said nose being composed of concentric longitudinal portions of increasing diameter starting from its free end, said rotational axis being parallel and eccentric with respect to the longitudinal axis of said nose.

Preferably the tool is equipped with handles which allow for the necessary angular displacement and advantageously said handles are connected to said body such that they can be arranged either in a line with the rotational axis or orthogonal to it in order to facilitate its engagement and transport.

In order to render the gripping more effective the external surface of said elongated members is advantageously axially or circumferentially grooved.

BRIEF DESCRIPTION OF THE DRAWINGS

The characteristics and advantages of the vicing tool according to the present invention will be made clearer in the following description of one of its possible embodiments given as an example but not limitative with reference to the attached drawings in which.

BEST MODE FOR CARRYING OUT THE INVENTION

With reference to the above mentioned drawings, 1 generically indicates a substantially cylindrical body formed by two halves la and lb coupled along two of their faces 2*a* and 2*b* and held together with an annular element 3 inside which the two halves 1*a* and 1*b* are engaged. The two halves 1*a* and 1*b* are angularly mobile with respect to one another about a longitudinal rotational axis, indicated by X, coincident with a common edge 4 of their faces 2*a* and 2*b*. Along said edge 4 are lodged spherical bodies 5 which allow for the rotation of the two halves. From the opposite side of the faces 2*a* and 2*b* with respect to the rotational axis X the two halves 1*a* and 1*b* present two faces 6*a* and 6*b* intersecting on the rotational axis X and forming an angle equal to the maximum relative angular displacement of the above mentioned halves.

Figure 1:
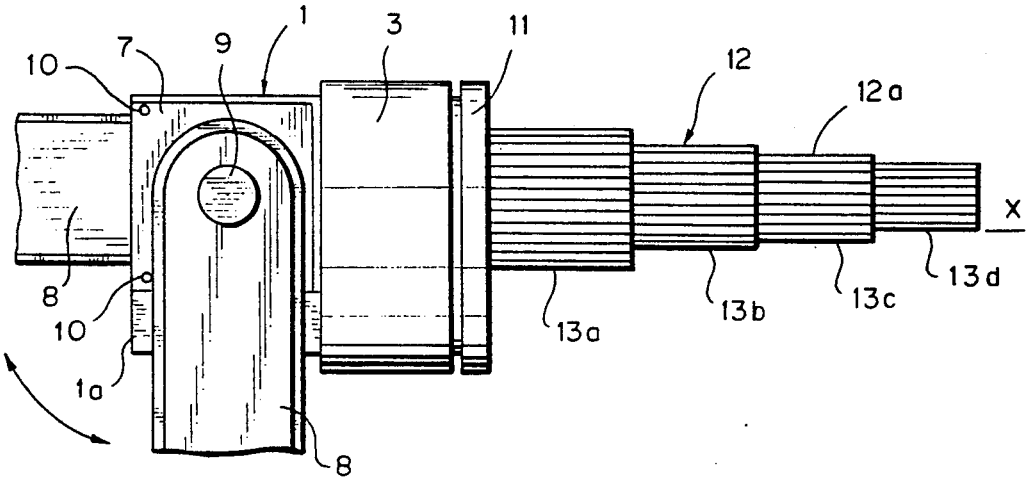
FIG. 1 is a side view of the vicing tool according to this invention.
Figure 2:
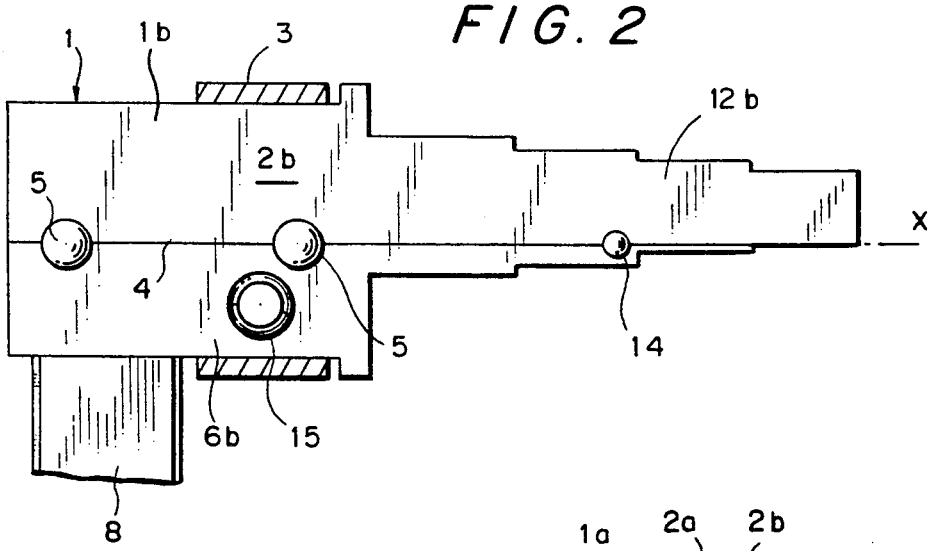
FIG. 2 is an internal view of one of the two halves of which the tool is composed.
Figure 3:
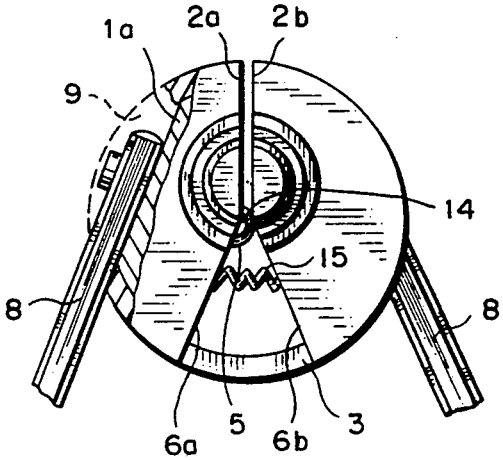
FIG. 3 is a partially cut away frontal view of the tool according to the invention.

The body 1 also presents two lateral flattenings, of which only one is set forth in FIGS. 1 and 3 and indicated by 7, formed in the external lateral surface and inclined such as to externally intersect on a line parallel to the rotational axis X. Preferably the angle formed between the two flattenings 7 should be greater than or equal to the angle between the two converging faces 6*a* and 6*b*. On the two flattenings 7 the ends of two handles 8 are fixed, also convergent, by means of respective pivots 9, about which the two handles 8 can be rotated to be arranged in one of the two positions indicated in FIG. 1 orthogonal to one another and therefore either along a direction parallel to the rotational axis X or along a direction orthogonal to it. In order to assure sufficient stability of handles 8 in both positions, from one hand the rotation about pivots 9 requires a certain force, from the other one on the two flattenings 7 projecting pins 10 are provided for, between which the handles 8, making contact against one another with their lateral sides, engage in a stick-slip-motion thanks to an elastic element not shown and of a known type, for example a Belleville washer, placed between the head of pivot 9 and handle 8.

From a base 11 of body 1, which is enlarged to act as a contact point for the ring 3, a nose 12 extends which also is composed of two parts or elongated members 12*a* and 12*b* extending respectively from the halves 1*a* and 1*b* and having a longitudinal axis parallel and eccentric with respect to the rotational axis X. The two elongated members 12*a* and 12*b* are each composed of longitudinal portions 13*a*, 13*b*, 13*c*, 13*d*, with external semicylindrical surfaces connected to one another along respective faces coplanar to faces 1*a* and 1*b*. In this embodiment of the invention the rotational axis X coincides with the generatrix of the cylindrical surface of the longitudinal portion 13*d* of smaller diameter. The rotational axis X intersects consequently with the section of the longitudinal portions of larger diameters which present two faces intersecting on said axis coplanarly to faces 6*a* and 6*b*. Also between the two longitudinal elements 12*a* and 12*b* of nose 12 at least one spherical body 14 is provided for along the rotational axis X in order to facilitate the relative rotation. Between the two halves of body 1, in particular between the two convergent faces 6*a* and 6*b* a spring 15 counteracting with handles 8 is provided for.

In the vicing tool according to this invention squeezing handles 8 the reciprocal rotation of halves 1*a* and 1*b* of body 1 about the axis X is obtained and therefore the opening of nose 12 with consequent increase of its diametrical dimensions. For this reason inserting the nose 12 into the hollow body, for example a pipe connection to be screwed or unscrewed, and squeezing handles 8 it is possible to grip the inside. In order to render the grasp more effective the external surface of the nose 12 is axially grooved.

The position of the rotational axis X in coincidence with the generatrix of the smaller longitudinal portion 13*d* is considered optimum, as far as other positions around it are possible. While is clear in fact that moving the rotational axis X near to the longitudinal axis of the nose 12 would mean a lesser possibility of opening out the nose itself, it has been seen that more distant positions, at least those coincident with the generatrix of the maximum longitudinal portion 13*a* of nose 12 result in a smaller usable internal contact surface with the hollow body to be engaged and consequent lesser grip effectiveness. Thanks to the presence of more different diameters on nose 12 it is possible to engage the nose in many other hollow bodies assuring for each a strength of grip sufficient to allow a continued gripping during rotation. It is also evident that, though not illustrated in detail, body 1 can be provided with two coaxial noses 12, situated simmetrically opposite one another in such a way as to significantly increase the range of use of the tool.

The above described embodiment of the invention illustrates a vicing tool of a manual type. It will become evident however to a person skilled in the art that it can be made automatic by substituting the handles 8 for example with hydraulic or pneumatic actuators of a conventional type as well as electromagnetic and motorized ones in another known way. Finally it is evident that the two halves 1*a* and 1*b* of the body 1 and the elongated members 12*a* and 12*b* of the nose 12 extending from said halves can be directly hinged to one another along the rotational axis X in that way being able to eliminate the connecting ring 3 of the two halves, even if the solution illustrated appears structurally more robust.

Other variations and/or modifications can be brought to the vicing tool for internally gripping hollow bodies, in particular those of tubular nature according to the present invention, without departing from the scope of the invention itself.

We claim:

1. A vicing tool for internally gripping hollow bodies, in particular those of tubular nature, comprising;

a body (1) made in two halves (1*a*, 1*b*) having two mating faces (2*a*, 2*b*) said two mating faces angularly displaceable with respect to one another about a rotational axis (X) coincident with a common edge (4) of said two mating faces, means (8) for imparting to said two halves of said body said angular displacement, a nose (12) extending from at lest one side of said body, said nose having two elongated members (12*a*, 12*b*) with substantially semicylindrical lateral surfaces, each of said members respectively extending from said two halves of said body and having a face coplanar and connected with said two mating faces of said body, said nose being composed of concentric longitudinal portions (13*a*, 13*b*, 13*c*, 13*d*), of an increasing diameter starting from a free end of said nose, said rotational axis being parallel and eccentric with respect to the longitudinal axis of said nose, a periphery of said body (1) having a circular section, and a slide guide (3) slidably mounted on said section for maintaining angular displacement of said two halves (1*a*, 1*b*).

2. A vicing tool according to claim 1, wherein rolling means are slidably engaged to said common edge (4) of said two mating faces (2*a*, 2*b*) for facilitating angular displacement of said two mating faces around said common edge.

3. A vicing tool according to claim 1, wherein said rotational axis is comprised between the generatrix of the smallest and the largest of said longitudinal portions (13*a*, 13*b*, 13*c*, 13*d*).

4. A vicing tool according to claim 1, wherein said rotational axis coincides substantially with the generatrix of the smallest of said longitudinal portions (13*a*, 13*b*, 13*c*, 13*d*).

5. A vicing tool according to claim 1, wherein said two halves (1*a*, 1*b*) of said body (1) and said two elongated members (12*a*, 12*b*) of said nose (12) present two faces convergent towards said rotational axis (x) from a part diametrically opposed to said mating faces (2*a*, 2*b*).

6. A vicing tool according to claim 1, wherein said lateral surfaces of said elongated members are axially grooved.

7. A vicing tool according to claim 1, wherein said means for imparting to said two halves (1*a*, 1*b*) of said body (1) said angular displacement are two handles (8) extending from said two halves of said body from opposite sides with respect to said rotational axis (X) and symmetrically with respect to said mating faces (2*a*, 2*b*).

8. A vicing tool according to claim 1, wherein between said two halves (1*a*, 1*b*) elastic means (15) are provided counteracting with said means for imparting the relative angular displacement.

9. A vicing tool according to claim 7, wherein said handles (8) are pivotally and spring biasedly connected to said two halves (1*a*, 1*b*) to permit arrangement either in a position which is substantially orthogonal with respect to said rotational axis (X) or in a position substantially parallel to said rotational axis (X).

10. A vicing tool according to claim 2, wherein said rolling means comprises a plurality of balls engaged in corresponding recesses located along said common edge.

11. A vicing tool according to claim 8, wherein said elastic means comprises a compressible spring.

* * * * *